United States Patent [19]

Cozzini

[11] 4,011,689

[45] Mar. 15, 1977

[54] GRINDING MACHINE

[76] Inventor: Artemio S. Cozzini, 3464 N. Dousman, Milwaukee, Wis. 53212

[22] Filed: Sept. 5, 1975

[21] Appl. No.: 610,845

[52] U.S. Cl. ..... 51/5 D; 51/80 R; 51/116; 125/11 B; 125/11 BS

[51] Int. Cl.[2] ..... B24B 53/04

[58] Field of Search ..... 51/80 R, 116, 5 D; 125/11 B, 11 BS

[56] References Cited

UNITED STATES PATENTS

| | | | |
|---|---|---|---|
| 1,369,789 | 1/1921 | Dawson | 125/11 B |
| 1,894,067 | 1/1933 | Smith | 125/11 B X |
| 2,393,937 | 1/1946 | Silven | 125/11 B |
| 2,425,453 | 8/1947 | Bavosi | 125/11 B |
| 3,543,446 | 12/1970 | Kilian | 51/80 R |

*Primary Examiner*—Harold D. Whitehead
*Attorney, Agent, or Firm*—Andrus, Sceales, Starke & Sawall

[57] ABSTRACT

A grinding machine incorporating a pair of cup-shaped grinding wheels. Each grinding wheel has an annular outer beveled surface, and the blade to be sharpened is inserted between the mating beveled grinding surfaces. Each grinding wheel can be moved in an axial direction to move the beveled grinding surfaces toward and away from each other. A dressing mechanism is incorporated which includes a pair of dressing pins mounted on a reciprocating bar, the ends of which are pivotally connected to the supporting structure through links. As the bar is moved longitudinally through a rack and pinion mechanism, the dressing elements move across the respective beveled grinding surfaces of the grinding wheels to dress the same.

15 Claims, 6 Drawing Figures

Fig. 1
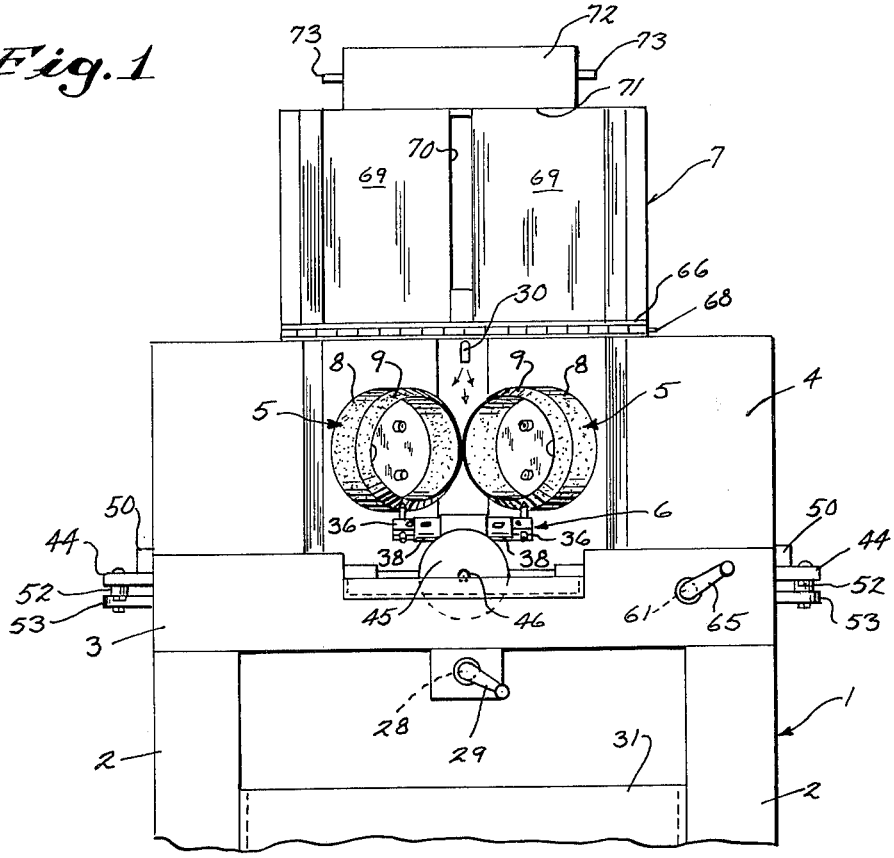
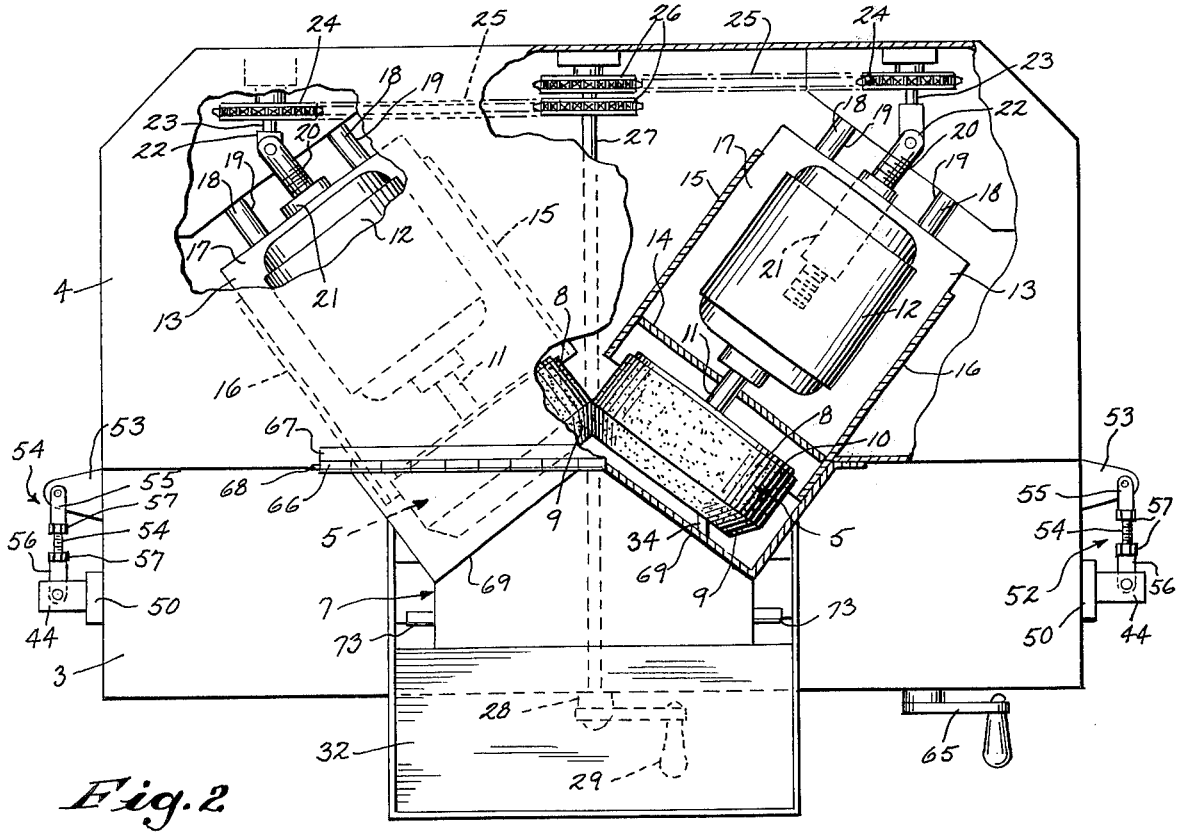
Fig. 2

Fig. 3
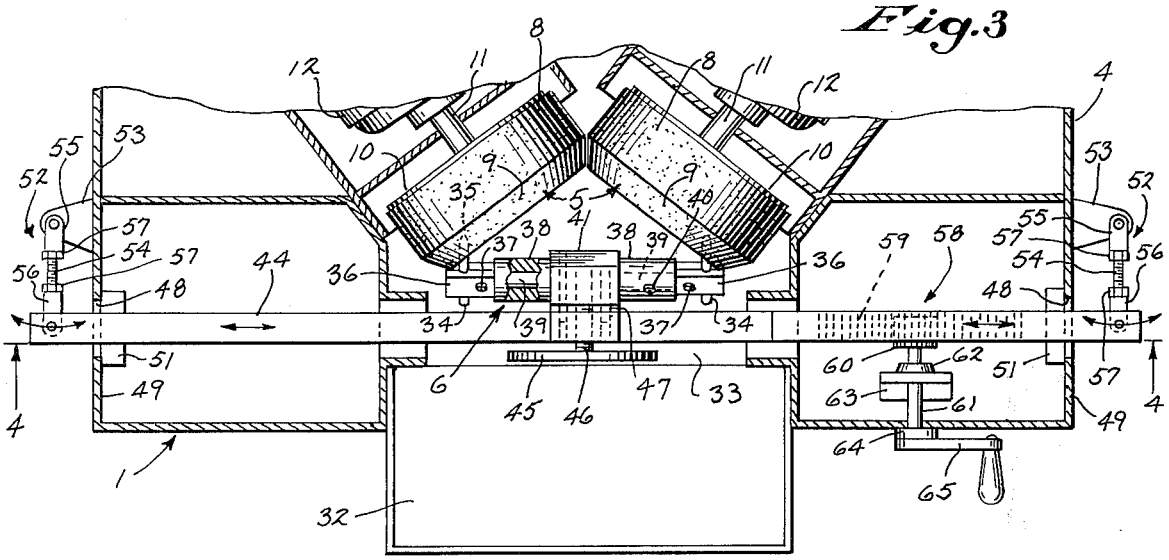
Fig. 4
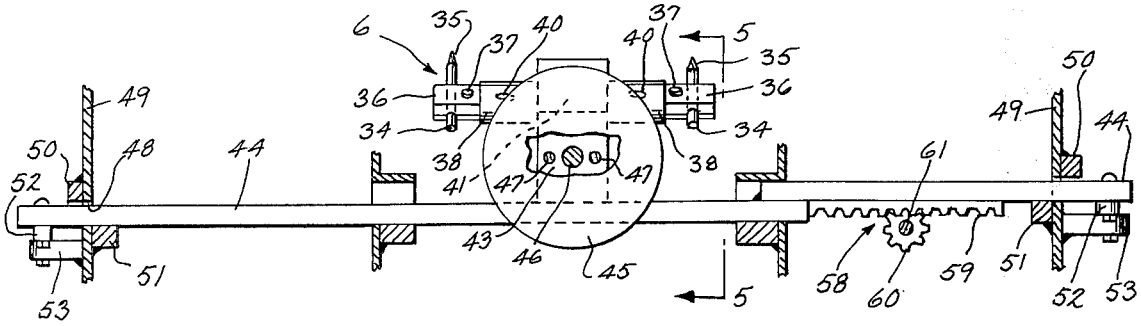
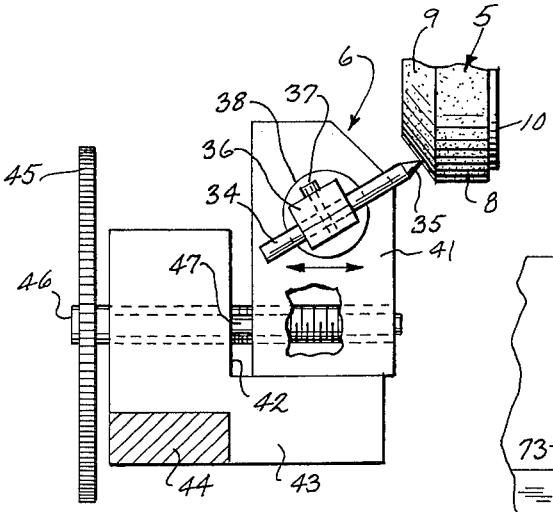
Fig. 5
Fig. 6
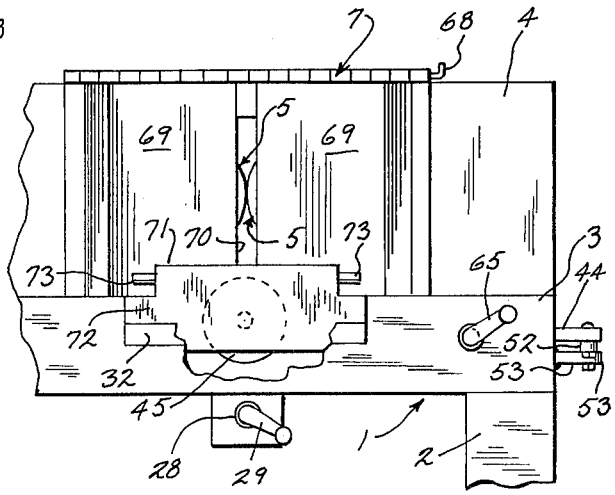

GRINDING MACHINE

BACKGROUND OF THE INVENTION

Knives and other tools are commonly sharpened by inserting the blade between cooperating grinding wheels. Cup-shaped hollow cylinder grinding wheels are used to hollow grind blades and have certain advantages over solid cylindrical grinding wheels. Cup-shaped grinding wheels have an outer beveled grinding surface located at an angle of about 50° to 60° with respect to the axis of the wheel and the blade to be sharpened is inserted between the mating beveled surfaces of the grinding wheels. With the use of cup-shaped grinding wheels, the depth of grinding, that is, the distance from the cutting edge of the blade to the back edge, remains constant regardless of the wear on the wheels. This differs from use of solid cylindrical grinding wheels in which the depth of grinding will vary as the wheels are worn.

Periodically, grinding wheels must be dressed to remove metal deposits from the wheels and to correct out-of-roundness or eccentricity due to wear. Dressing of the beveled grinding surfaces of cup-shaped grinding wheels is difficult due to the fact that the beveled grinding surfaces are not in a common plane, except for the line of tangency where the surfaces mate, so that the dressing of the beveled surfaces has normally been done by individually dressing the wheels, as opposed to simultaneously dressing both wheels.

SUMMARY OF THE INVENTION

The invention relates to an improved grinding machine using cup-shaped grinding wheels having outer beveled grinding surfaces and having a dressing mechanism which enables both of the grinding wheels to be dressed simultaneously. In accordance with the invention, a pair of grinding wheels are mounted such that the beveled grinding surfaces are disposed in proximate relation along the line of tangency and the blade to be sharpened is inserted between the mating surfaces.

Each grinding wheel is driven by a motor, and each grinding wheel along with the respective motor is mounted for sliding movement in an axial direction. An adjusting mechanism interconnects the sliding units so that both grinding wheels and motors will be moved simultaneously in a direction to move the beveled grinding surfaces toward and away from each other.

The dressing mechanism acts to simultaneously dress the beveled grinding surfaces of each grinding wheel. A pair of diamond-tipped dressing pins are mounted on a reciprocating support bar, and the ends of the bar are pivotally connected through adjustable links to the housing or supporting structure. A rack and pinion mechanism is employed to move the bar in a generally longitudinal direction, and due to the linked connection, the bar and the dressing pins will move in a slightly arcuate path of travel.

As the bar moves from an end of its path of travel to the mid-point, one of the dressing pins rides across the beveled surface of the respective grinding wheel to dress the beveled surface, and as the bar continues from the mid-point of its path of travel to the opposite end, the other of the dressing pins rides across the beveled surface of the other grinding wheel to dress the same.

The dressing mechanism enables the beveled grinding surfaces of the grinding wheels to be simultaneously dressed by a single dressing mechanism, even though the beveled grinding surfaces, outside the line of tangency, do not lie in a single plane.

The grinding machine also includes a novel cover which is hinged to the housing and encloses the grinding wheels as well as the dressing mechanism. The cover has an access opening through which the blade or tool can be inserted for sharpening.

Other objects and advantages will appear in the course of the following description.

DESCRIPTION OF THE DRAWINGS

The drawings illustrate the best mode presently contemplated of carrying out the invention.

In the drawings:

FIG. 1 is a front elevation of the grinding machine of the invention with the cover in the open position;

FIG. 2 is a top plan view of the grinding machine with parts broken away;

FIG. 3 is a fragmentary plan view with parts broken away and showing the dressing mechanism;

FIG. 4 is a section taken along line 4—4 of FIG. 3;

FIG. 5 is a section taken along line 5—5 of FIG. 4; and

FIG. 6 is a fragmentary front elevation of the machine with the cover in the closed position.

DESCRIPTION OF THE PREFERRED EMBODIMENT

The drawings illustrate a grinding machine composed of a frame or supporting structure 1 including a series of legs 2 and a generally horizontal table area 3. The upper portion of the supporting structure defines a housing 4 which houses a pair of cup-shaped grinding wheels 5, as well as a dressing mechanism, indicated generally by 6, which is employed to dress the grinding wheels. During use, the grinding wheels and dressing mechanism are enclosed by a hinged cover 7 that is pivoted to the housing 4.

As best shown in FIG. 3, each of the grinding wheels 5 includes a generally cylindrical section 8 and a beveled section 9 which is disposed at an angle of about 30° to 40°, and preferably about 36° with respect to the cylindrical section 8. Each grinding wheel 5 is secured to a mounting plate 10 that is connected to a shaft 11 of motor 12. As shown in FIG. 2, each of the motors 12 is secured to a slide assembly 13 that is mounted for sliding movement with respect to the frame 1.

Each slide assembly 13 includes a front plate 14, a pair of side plates 15 and 16 and a bottom plate 17 which carries the motor 12. Guides 18 are secured to the bottom plate 17 and engage guideways 19 formed in the frame 1 to guide the slide assembly 13 in movement parallel to the axis of the shaft 11.

To move each of the guide wheels 5 in an axial direction, a shaft 20 is threaded within a sleeve 21 secured to the bottom plate 17 of slide assembly 13. As illustrated in FIG. 2, the outer end of each shaft 20 is connected through a universal coupling 22 to a shaft 23 that carries sprocket 24 and each sprocket 24 is connected by a chain 25 to a sprocket 26 mounted on the central shaft 27.

Shaft 27 extends forwardly beneath the grinding wheels and the forward end of the shaft is journaled within a bracket 28 secured to frame 1. Secured to the outer end of the shaft is a handle 29. With this construction, rotation of the shaft 27 through handle 29 will operate to rotate the threaded shafts 20 and simultaneously move both of the slide assemblies 13 relative to the frame 1. This action will move the beveled surfaces 9 of the grinding wheels 5 in a direction to increase or decrease the spacing between the grinding surfaces 9.

As illutrated in FIG. 2, the beveled grinding surfaces 9 are disposed in proximate relation along a line of tangency and the knife, or other tool to be ground, is inserted between the cooperating beveled surfaces 9 to grind the blade with a hollow ground cut.

During the grinding operation, water or other cooling liquid is supplied to the area of the grinding surfaces 9 through a line 30 which is connected to a sump or reservoir 31 located between the legs 2 of the frame. A pump, not shown, is located within the sump 31 and acts to pump the water through the line 30 where it is discharged above the grinding wheels 5. Located beneath the grinding wheel is a trough 32 which terminates in an open hopper-like bottom 33 and the water will fall into the trough and flow through the open bottom 33 back into the sump 31.

The grinding machine of the invention also includes a unique dressing mechanism which includes a pair of dressing pins or elements 34 having generally conical diamond-shaped tips 35. Each dressing pin is clamped within a split block 36 and is held within the block by a set screw 37. The lower half of each block is secured to a sleeve 38 which can be rotated about a central shaft 39 to change the angular position of the dressing pins 34. Sleeve 38 can be locked with respect to shaft 39 by means of set screw 40.

During normal operation of the grinding machine, the position of the dressing pin 34 is not altered. To compensate for wear of the dressing pins 34, the dressing pins can be rotated with respect to the block 36 by release of set screw 37, while the angular position of the dressing pins can be varied by rotating sleeves 38 on release of set screws 40.

As shown in FIG. 5, the shaft 39 is carried by a support 41 which is mounted for sliding movement within a recess 42 in block 43 in a direction toward and away from the grinding wheel 5. Block 43 is mounted on the central portion of an elongated bar 44.

To adjust the position of the dressing pins 34 in a direction toward and away from the grinding wheels 5, a hand wheel 45 is mounted on a horizontal shaft 46 that is threaded within an opening in the block 43 and is secured to support 41. Guide pins 47 are connected to the block 43 and extend within aligned holes in the support 41. With this construction, rotation of the hand wheel 45 will act to move the support 41 and dressing pins 34 in a direction toward and away from the grinding wheels 5 and will determine the dressing cut or the amount of the wheel surface removed by the dressing pins.

As illustrated in FIG. 3, the ends of the bar 44 extend through opening 48 in the side walls 49 of the frame, and the bar is guided for sliding movement within the openings by guides 50 and 51. The guides 51 are secured to the inner surfaces of the respective side walls 49, and are located beneath the bar 44, while guides 50 are mounted on the outer surfaces of the side walls 49 and are located above the bar.

As shown in FIG. 3, each end of the bar 44 is pivotally connected to the frame through an adjustable link 52 which connects the end of the bar to a bracket 53 secured to the side wall 49. Each of the links 52 includes a threaded rod 54, the ends of which are threaded into couplings 55 and 56 and retained therein by nuts 57. The rods 54 and couplings 55 and 56 provide an adjustment for the length of the links, and this adjustment can be used to adjust the path of travel inscribed by the dressing pins.

To move the bar 44 in a generally longitudinal direction, a rack and pinion mechanism 58 is employed which includes a rack 59 secured to the undersurface of the bar 44, and the rack is engaged by a pinion 60 mounted on horizontal shaft 61. As shown in FIG. 3, shaft 61 is journaled within a bearing assembly 62 carried by an L-shaped bracket 63 and by a bearing assembly 64 mounted on the front wall of the frame 1. The outer end of shaft 61 carries a handle 65. By rotating handle 65, the pinion 60 will rotate in engagement with the rack 59 to move the bar 44 in a generally longitudinal path. However, due to the connection of the ends of the bar by links 52 to the frame, the rack will inscribe a slightly arcuate or curved path, and during this movement the rack 59 will move in the direction of shaft 61 with respect to the pinion 60.

As the bar 44 moves in the slightly curved reciprocating path of travel, the tips 35 of dressing pins 34 will move across the beveled surfaces 9 of the respective grinding wheels 5 to dress the same. As the bar moves from an end of its path of travel to the mid-point, one of the dressing pins rides across the beveled surface of the respective grinding wheel to dress the beveled surface, and as the bar continues from the mid-point of its path of travel to the opposite end, the other of the dressing pins rides across the beveled surface of the other grinding wheel to dress the same.

The beveled grinding surfaces 9, except for the line of tangency between the grinding surfaces, do not lie in a common plane and thus a linear movement of the dressing mechanism could not simultaneously dress both of the beveled surfaces 9. However, with the dressing mechanism of the invention, the bar 44 will operate to dress both of the surfaces simultaneously, due to its arcuate path of movement provided by the links 52.

The cover 7, which is adapted to enclose the grinding wheel 5 and dressing mechanism 6, includes an upper section 66 having a series of hinge tubes which mate with hinge tubes formed on a plate 67 attached to housing 4. Hinge pin 68 extends through the aligned hinge tubes to hinge the cover to the housing 4.

As best shown in FIG. 2, the cover includes a pair of generally V-shaped sections 69 which enclose the grinding wheels 5, and the central portion of the cover between the V-shaped sections 69 is provided with a slot 70 through which the knife or other tool is inserted for the grinding operation.

Located beneath the V-shaped sections 69 is a generally horizontal section 71 which terminates in a skirt 72 that extends downwardly into the trough 32. A pair of lift pins 73 are located along the sides of the cover and enable the operator to conveniently pivot the cover up to a non-operating or storage position.

The cover encloses the grinding wheels and the dressing mechanism 6 during operation, and the lower edge of the hand wheel 45 is exposed beneath the skirt 72, as shown in FIG. 6, so that the operator, by merely reaching under the skirt, can turn the hand wheel to adjust the in-and-out position of the dressing pins 34 with respect to the grinding wheels.

The grinding machine of the invention includes a provision for simultaneously dressing the beveled grinding surfaces 9 of the grinding wheels 5. This is accomplished through the novel connection of the bar 44 to the supporting structure through use of the links 52, which enables each of the dressing pins to move directly across the respective beveled surface 9, as the bar approaches each end of its reciprocating path of travel.

The grinding machine also includes a provision for simultaneously moving both grinding wheels in a direction to increase or decrease the spacing between the beveled surfaces 9.

The cover 7 encloses the operating mechanism, including the grinding wheels and the dressing mechanism, but permits convenient access to the handwheel 45 for adjustment of the position of the dressing pins.

Various modes of carrying out the invention are contemplated as being within the scope of the following claims particularly pointing out and distinctly claiming the subject matter which is regarded as the invention.

I claim:

1. A grinding machine, comprising a supporting structure, a pair of grinding wheels mounted for rotation with respect to the supporting structure, each grinding wheel having a generally cylindrical surface and an outer beveled surface disposed at an angle of less than 45° with respect to said cylindrical surface, said beveled surfaces disposed in mating relation to grind a blade inserted therebetween, dressing means including a separate dressing element for each grinding wheel for dressing the beveled surface of the respective grinding wheels, support means to carry the dressing means, and mounting means for mounting the support means for movement in a non-linear path with respect to the supporting structure such that each dressing element will move across the respective beveled surface to dress the same during movement of said support means.

2. The grinding machine of claim 1, wherein said support means includes an elongated bar and said mounting means comprises a linkage disposed at each end of the bar for pivotally connecting the bar to said supporting structure, and operating means for moving the bar in a generally longitudinal direction whereby each dressing element will move through a slightly curved path of travel to dress the beveled surface.

3. The grinding machine of claim 2, wherein said operating means comprises a rack member and a pinion member, one of said members being connected to said support means and the other of said members being connected to said supporting structure.

4. A grinding machine, comprising a supporting structure, a pair of generally cup-shaped grinding wheels mounted for rotation on the supporting structure, each grinding wheel having an outer generally cylindrical surface and an outer beveled surface disposed at an angle of less than 45° with respect to said cylindrical surface, said beveled surfaces being disposed in proximate mating relation along a lone of tangency to grind an article inserted therebetween as the wheels are rotated, drive means for rotating said wheels, a pair of dressing members with each dressing member disposed to dress the beveled grinding surface of one of said grinding wheels, a bar to support the dressing members in spaced relation, a link pivotally connecting each end of the bar to the supporting structure whereby the bar can move in a slightly arcuate reciprocating path of travel, one of said dressing members disposed to ride across the beveled surface of the corresponding grinding wheel as the support bar is moved from one end of the path of travel toward the mid-point of the path of travel and the other of said dressing members disposed to ride across the beveled surface of the other grinding wheel as the bar is moved in the same direction from said mid-point to the opposite end of said path of travel, and operating means for moving said bar in said path of travel.

5. The grinding mechanism of claim 4, and including slide means to support the drive means for each grinding wheel, each slide means being mounted for sliding movement in a direction parallel to the axis of the respective grinding wheel, and adjusting means for moving each slide means in the respective direction to vary the spacing between said beveled grinding surfaces.

6. The grinding mechanism of claim 4, and including adjustment means for varying the length of said links.

7. The grinding machine of claim 4, and including positioning means for moving the bar in a direction generally normal to the longitudinal dimension of the bar to move the dressing members toward and away from the grinding wheels.

8. The grinding machine of claim 4, wherein the dressing members are pins having generally pointed tips.

9. The grinding machine of claim 4, and including a cover connected to the supporting structure and enclosing said grinding wheels and said dressing members, said cover having a slot through which the article to be ground is inserted.

10. The grinding machine of claim 9, wherein said cover is hinged to the supporting structure and is pivotable between a closed and an open position.

11. The grinding machine of claim 7, wherein the positioning means includes a manual operating member, said machine also including a cover connected to the supporting structure and enclosing said grinding wheels and said dressing members, said cover having a slot through which the article to be ground is inserted, said cover having a downwardly extending skirt partially enclosing said operating member.

12. The grinding machine of claim 1, wherein each dressing means comprises an elongated element, said machine including means for adjusting the position of the element in an axial direction with respect to the support means.

13. The grinding machine of claim 4, wherein said operating means comprises a rack connected to the bar and a rotatable pinion engaged with the rack.

14. The grinding machine of claim 4, wherein said supporting structure includes a pair of spaced side wall, said machine including a bracket connected to said side wall, one end of each link being pivoted to the corresponding bracket and the opposite end of each link being pivoted to the corresponding end of the bar.

15. A grinding machine, comprising a supporting structure, a pair of generally cup-shaped grinding wheels mounted for rotation on the supporting structure, each grinding wheel having an outer generally cylindrical surface and an outer beveled surface disposed at an acute angle with respect to said cylindrical surface, said beveled surfaces being disposed in proximate mating relationship along a line of tangency to grind an article inserted therebetween as the wheels are rotated, drive means for rotating said wheels, a pair of dressing members with each dressing member disposed to dress the beveled grinding surface of one of said grinding wheels, support means to carry the dressing members, and means for moving the support means in a path of travel to move one of said dressing members across the beveled surface of the respective grinding wheel at a location spaced from said line of tangency during a first portion of said path of travel and to move the other of said dressing members across the beveled surface of the other grinding wheel at a location spaced from said line of tangency during a second portion of said path of travel.

* * * * *

UNITED STATES PATENT AND TRADEMARK OFFICE

CERTIFICATE OF CORRECTION

PATENT NO. : 4,011,689

DATED : March 15, 1977

INVENTOR(S) : ARTEMIO S. COZZINI

It is certified that error appears in the above-identified patent and that said Letters Patent are hereby corrected as shown below:

Column 3, Line 6, Cancel "illutrated" and substitute therefor ---illustrated---, Column 5, Line 58, Claim 4, Cancel "lone" and substitute therefor ---line---, Column 5, Line 53, Claim 14, Cancel "said", second occurrence, and substitute therefor ---each---.

Signed and Sealed this

*Thirteenth* Day of *September 1977*

[SEAL]

*Attest:*

RUTH C. MASON
*Attesting Officer*

LUTRELLE F. PARKER
*Acting Commissioner of Patents and Trademarks*